US005551496A

United States Patent [19]

Gray, Jr.

[11] Patent Number: 5,551,496

[45] Date of Patent: Sep. 3, 1996

[54] CONCEALABLE WALLET

[76] Inventor: Hugh H. Gray, Jr., 820 Sunset Blvd., Apt. 22, Kenner, La. 70065

[21] Appl. No.: 371,124

[22] Filed: Jan. 11, 1995

[51] Int. Cl.[6] ..... A45C 1/02; A45C 1/06; A45C 13/18

[52] U.S. Cl. ..... 150/134; 150/102; 150/143; 2/247

[58] Field of Search ..... 150/102, 134, 150/101; 2/247–251

[56] References Cited

U.S. PATENT DOCUMENTS

| | | | |
|---|---|---|---|
| 146,232 | 1/1874 | Clarke | 2/247 |
| D. 261,196 | 10/1981 | Griffin | D2/383 |
| 437,903 | 10/1890 | Jacobs | 2/247 |
| 1,088,784 | 3/1914 | Livingston | 2/247 X |
| 1,425,889 | 8/1922 | Meisner | 2/249 |
| 2,392,533 | 1/1946 | Isaac | 150/134 X |
| 2,474,495 | 6/1949 | Pollak | 2/247 X |
| 2,725,573 | 12/1955 | Kornhauser | 2/247 |
| 3,220,452 | 11/1965 | Mintzes et al. | 150/134 |
| 3,387,641 | 6/1968 | Osborne | 150/38 |
| 4,416,315 | 11/1983 | Foley | 150/134 |
| 4,570,688 | 2/1986 | Williams | 150/134 |
| 4,602,390 | 7/1986 | Morera et al. | 2/247 X |
| 4,705,086 | 11/1987 | O'Neill | 150/134 |
| 4,744,495 | 5/1988 | O'Neal | 150/134 X |
| 4,749,113 | 6/1988 | Grubman | 224/229 |
| 4,811,768 | 3/1989 | Williams | 150/102 |
| 5,082,157 | 1/1992 | Emerson-Santos | 224/229 |

FOREIGN PATENT DOCUMENTS

| | | | |
|---|---|---|---|
| 512198 | 1/1954 | Belgium | 150/132 |
| 1509104 | 12/1967 | France | 2/247 |
| 591208 | 1/1934 | Germany | 2/247 |
| 56397 | 4/1924 | Sweden | 150/134 |
| 289955 | 5/1928 | United Kingdom | 2/247 |
| 383469 | 11/1932 | United Kingdom | 2/247 |

*Primary Examiner*—Sue A. Weaver
*Attorney, Agent, or Firm*—Joseph N. Breaux

[57] ABSTRACT

A concealable wallet comprising a wallet member having a pocket for storing items and an attachment strap for securely attaching the wallet member to the garment while in use. The pocket is accessible through a sealable opening and is sized to allow flat rectangular objects such as a stack of currency to be stored therein. The wallet member may include a flap section, having a hook and pile type fastener attached thereto, located adjacent the sealable opening; and a second section of hook and pile type fastener attached to the sidewall near the opening in a manner such that the flap may be secured over the sealable opening by connecting the two sections of hook and pile fastener. The attachment strap is elongated and attached to the wallet member along its midsection. Both ends of the attachment strap extend out past the wallet member. One of the ends has an adjustable length fastening mechanism attached thereto. The adjustable length fastening mechanism is of the type suitable for fastening about a belt loop of a garment. The other end of the attachment strap has a button attachment mechanism fastenable about a button of the garment. The button attachment mechanism may include a button hole formed at the end of the attachment strap or a second adjustable length fastening mechanism. The wallet member and the attachment strap preferably constructed of a material which will match the garment with which the concealable wallet is to be used.

1 Claim, 8 Drawing Sheets

CONCEALABLE WALLET

TECHNICAL FIELD

The present invention relates to devices used for storing items on a person and more particularly to devices used for storing items on a person that allow the individual to store items in a concealed manner.

BACKGROUND ART

It is often desirable to store valuable items, such as cash and jewelry, in a concealed location upon one's body while carrying such items on one's person. It would, therefore, be desirable to have a device for storing and carrying valuable items which could be concealed by the wearer's clothing. In addition, it would also be desirable, if the individual wearing such a device could readily confirm that the device is secured in the correct position without calling attention to the device to a bystander.

GENERAL SUMMARY DISCUSSION OF INVENTION

It is thus an object of the invention to provide a concealable wallet that will allow the user to readily confirm attachment of the wallet while in use.

It is a further object of the invention to provide a concealable wallet that is comfortable to wear.

It is a still further object of the invention to provide a concealable wallet that may be worn with a variety of differently styled garments.

Accordingly, a concealable wallet for use with a garment is provided. The concealable wallet comprises a wallet member for storing items and an attachment strap for securely attaching the wallet member to the garment while in use. The wallet member has first and second sidewalls attached in a manner to form a pocket therebetween. The pocket is accessible through a sealable opening formed through the first sidewall and is sized to allow flat rectangular objects such as a stack of currency to be stored therein. The wallet member may be constructed of any flexible material such as fabric or leather and is preferably constructed of the same material as the garment with which it is to be used.

The sealable opening may be sealable with any device known in the art such as snaps, zippers or hook and pile type fasteners. The wallet member may include a flap section, having a hook and pile type fastener attached thereto, located adjacent the sealable opening; and a second section of hook and pile type fastener attached to the first sidewall 1 near the opening in a manner such that the flap may be secured over the sealable opening by connecting the two sections of hook and pile type fastener.

The attachment strap is elongated and attached to the wallet member along its midsection. The attachment strap may be attached to either sidewall, however, it is preferred to attach the attachment strap to the sidewall not having the sealable opening therethrough. Both ends of the attachment strap extend past the wallet member. One of the ends has an adjustable length fastening mechanism attached thereto. The adjustable length fastening mechanism is of the type suitable for fastening about a belt loop of a garment. The other end of the attachment strap has a button attachment mechanism fastenable about a button of a garment for attaching. The button attachment mechanism may include a button hole formed at the end of the attachment strap or a second adjustable length fastening mechanism. The attachment strap is preferably constructed of a material that matches the garment with which the concealable wallet is to be used.

The adjustable length fastening mechanism preferably includes a resilient member and an elongated flexible member, such as a length of cord. The resilient member has a first and second holding channel through which sections of the flexible member may be installed. Each channel has sidewalls that frictionally contact and hold the flexible member in a desired position. One of the holding channels includes an insertion channel running along a side thereof of a size sufficient to allow a section of said flexible member to be inserted laterally therethrough. The elongated flexible member is preferably constructed of a material that matches the garment with which the concealable wallet is to be used.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
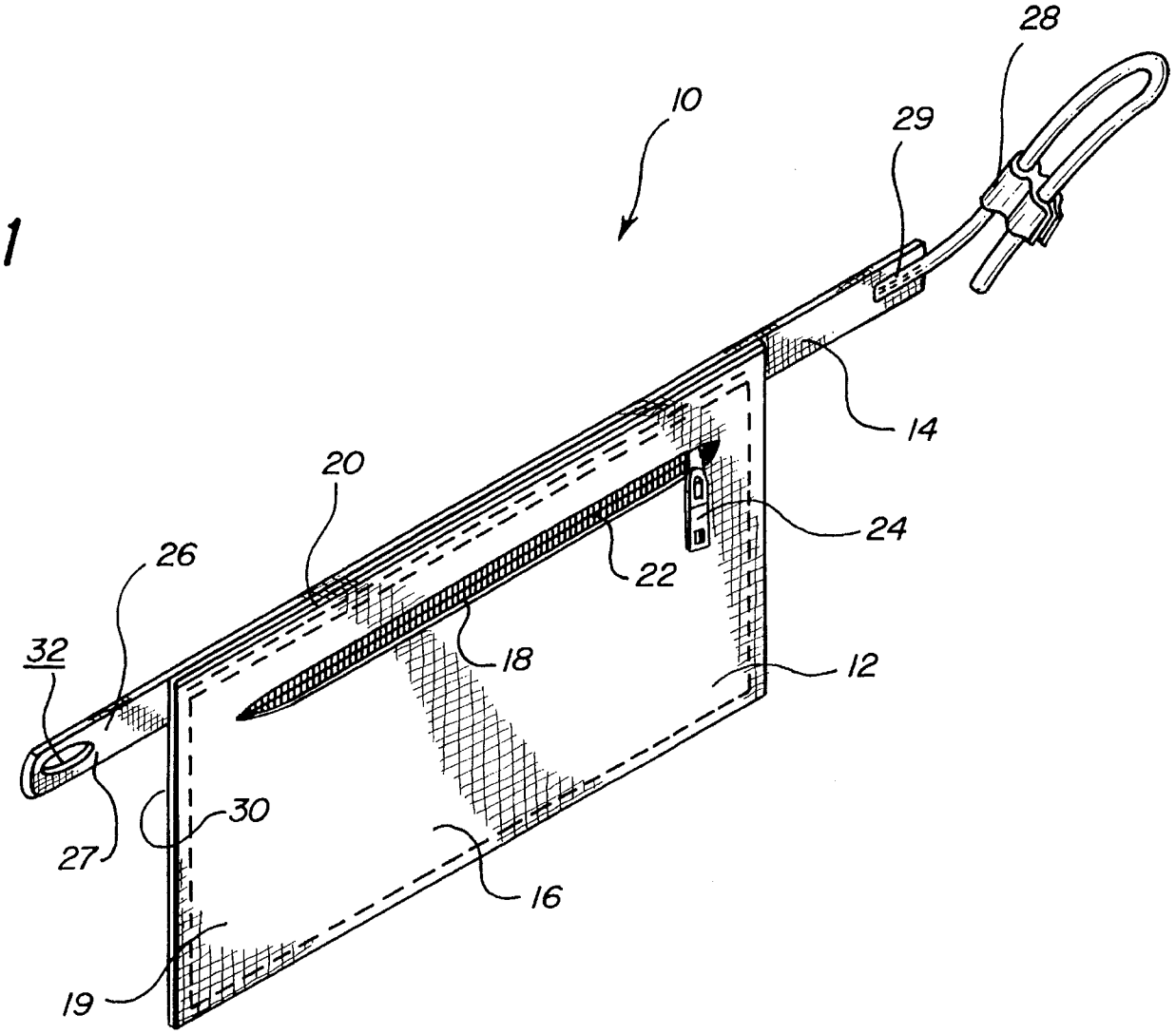
FIG. 1 is a perspective view of an exemplary embodiment of the concealable wallet of the present invention.

FIG. 1 shows an exemplary embodiment of the concealable wallet of the present invention generally designated by the numeral 10. Concealable wallet 10 includes a wallet member 12 and an attachment strap 14.

Wallet member 12 is constructed from a substantially rectangularly shaped, 7 inch by 7¼ inch section 16 of denim fabric which has been folded over along the midpoints of the 7 inch sides and double stitched along all four sides to form about a 3 inch by 6¾ inch pocket (not shown) of sufficient size to receive about a one-quarter (¼") inch stack of six and one-quarter (6¼") inch by two and five-eights (2⅝") inch currency bills therein without requiring folding of the bills. A sealable opening 18 is located on one side 19 of wallet member 12 and adjacent one of the longer sides 20. A zipper 22, having a zipper pull 24, is stitched into sealable opening 18 to allow sealable opening 18 to be sealed when items are stored within the pocket.

Attachment strap 14 is about an 11 inch length of blue, webbed nylon strapping having a button connector 26 at one end 27 and an adjustable length fastener 28 at the other end 29. Attachment strap 14 is stitched midway along its length to the opposite side 30 of wallet member 12, adjacent the same side 20 as sealable opening 18. Button connector 26 consists of a button hole 32 formed about ⅓ inch from the terminal portion of end 27.

Figure 2:
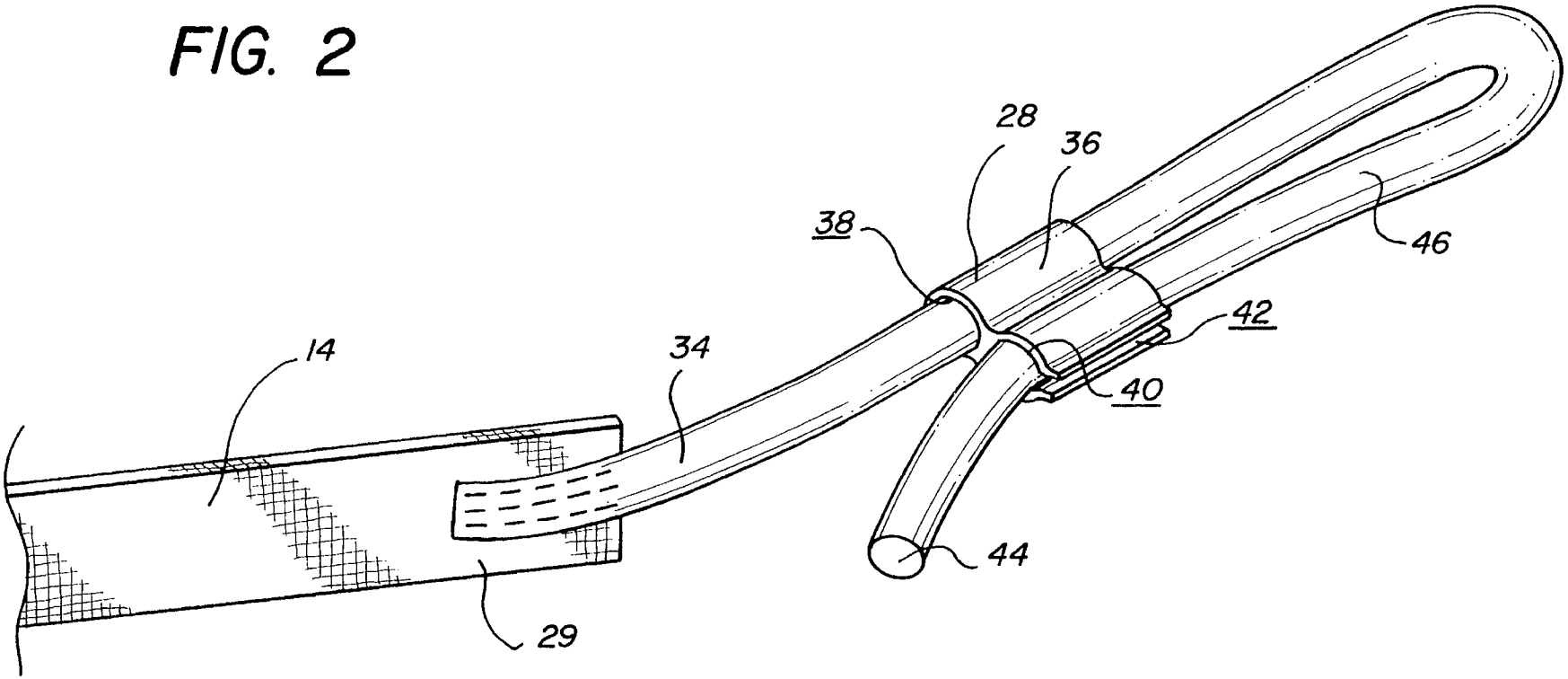
FIG. 2 is a perspective detail view of the adjustable fastener of the exemplary embodiment of FIG. 1.
Figure 3:
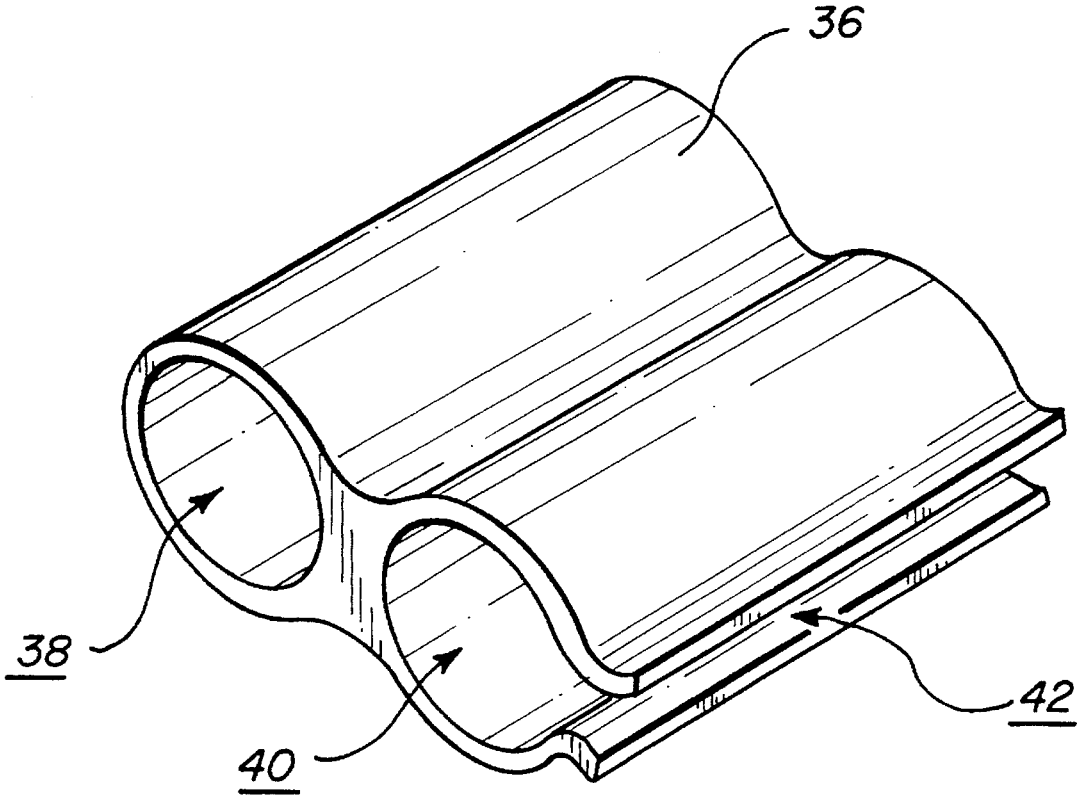
FIG. 3 is a perspective view of the cord clamp of the adjustable fastener in isolation.

Adjustable length fastener 28, as shown in FIG. 2, includes a flexible cord 34 and a cord clamp 36. Cord 34 is section of ⅛ inch diameter, blue, nylon cord about 10 inches long. Adjustable length fastener 28 is adjustable between one and six (1"–6") inches to allow for securement with a variety of different sized and styled garments. Cord clamp 36 is shown in isolation in FIG. 3. Cord clamp 36 is constructed of resilient plastic and has a first and second ⅛ inch diameter holding channels 38,40. Second holding channel 40 has an insertion channel 42 formed along its entire length.

With reference again to FIG. 2, a first end 44 of cord 34 is inserted through first holding channel 38 and cord clamp 36 positioned near end 29 of attachment strap 14. An attachment loop 46 may be formed by positioning a section of cord 34 into second holding channel 40 via lateral insertion of the cord section through insertion channel 42.

Figure 4:
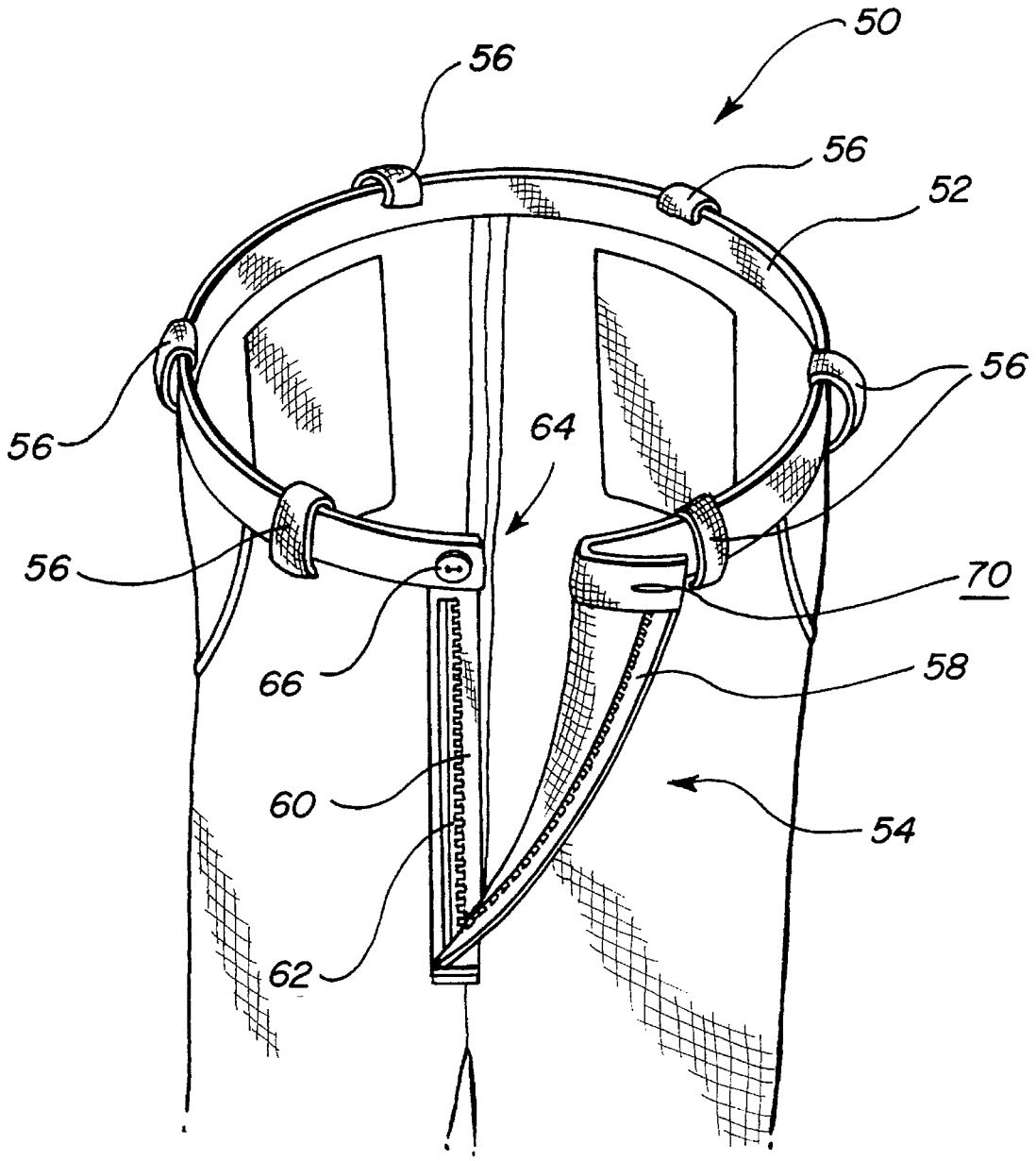
FIG. 4 is a perspective view of a representative garment of the type which may be worn in conjunction with the concealable wallet of FIG. 1.

FIG. 4 shows a partial view of a representative pair of slacks, generally designated by the numeral 50. Slacks 50 include a waist band 52, and a garment closure 54. Waist band 52 has six belt loops 56 spaced along its length. Garment closure 54 includes over and under flaps 58,60 which are securable by a garment zipper 62 and a button assembly 64. Button assembly 64 includes a button 66, attached to a top portion of under flap 60; and a button hole 70, formed on a top portion of over flap 58. Button 66 and button hole 70 are positioned such that, when garment zipper 62 is zipped shut, button 66 may be inserted through button hole 70 to secure the top portion of garment closure 54 in a closed position.

Figure 5:
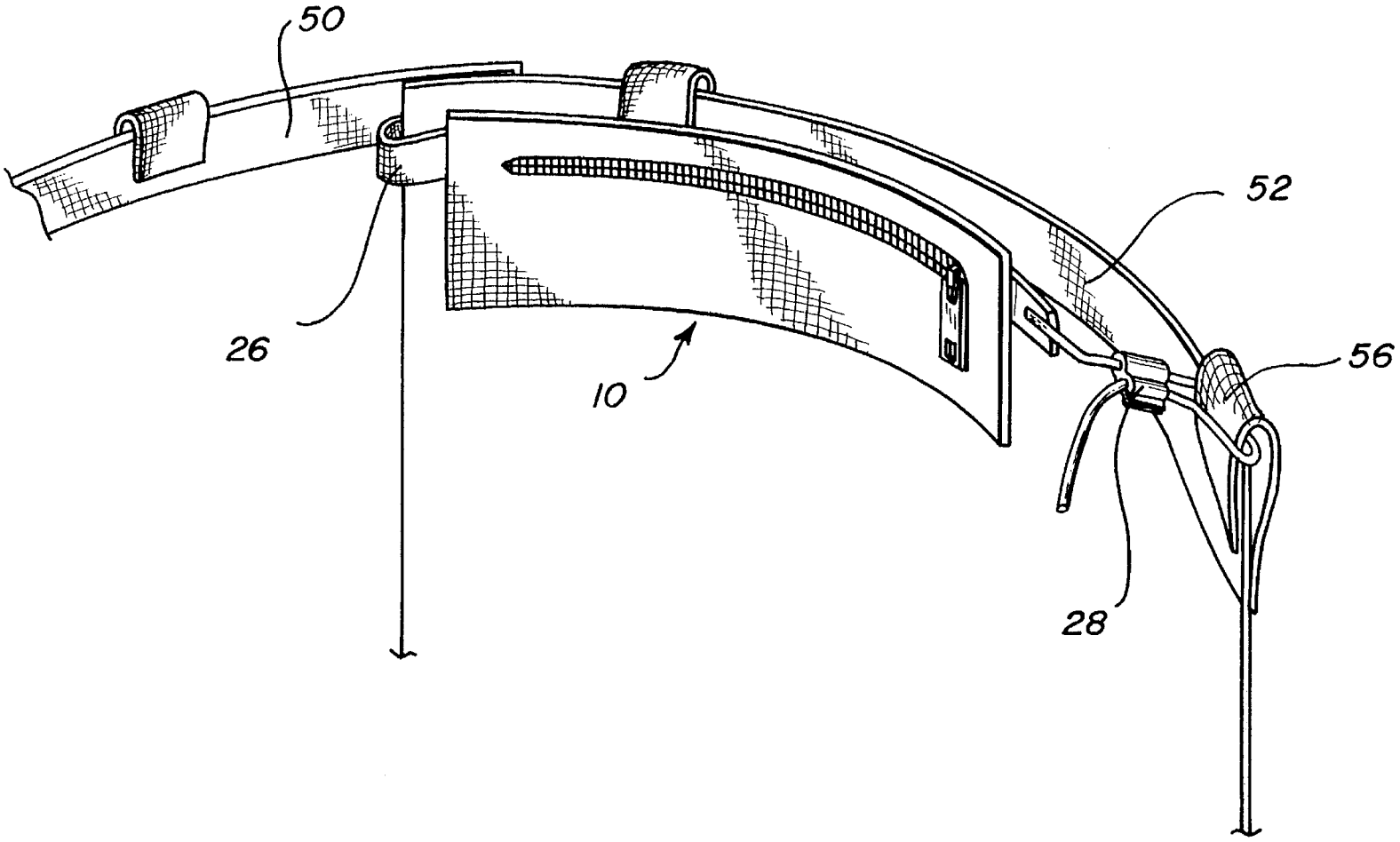
FIG. 5 is a perspective cut-away view of one method of attaching the concealable wallet to the representative garment of FIG. 4.
Figure 6:
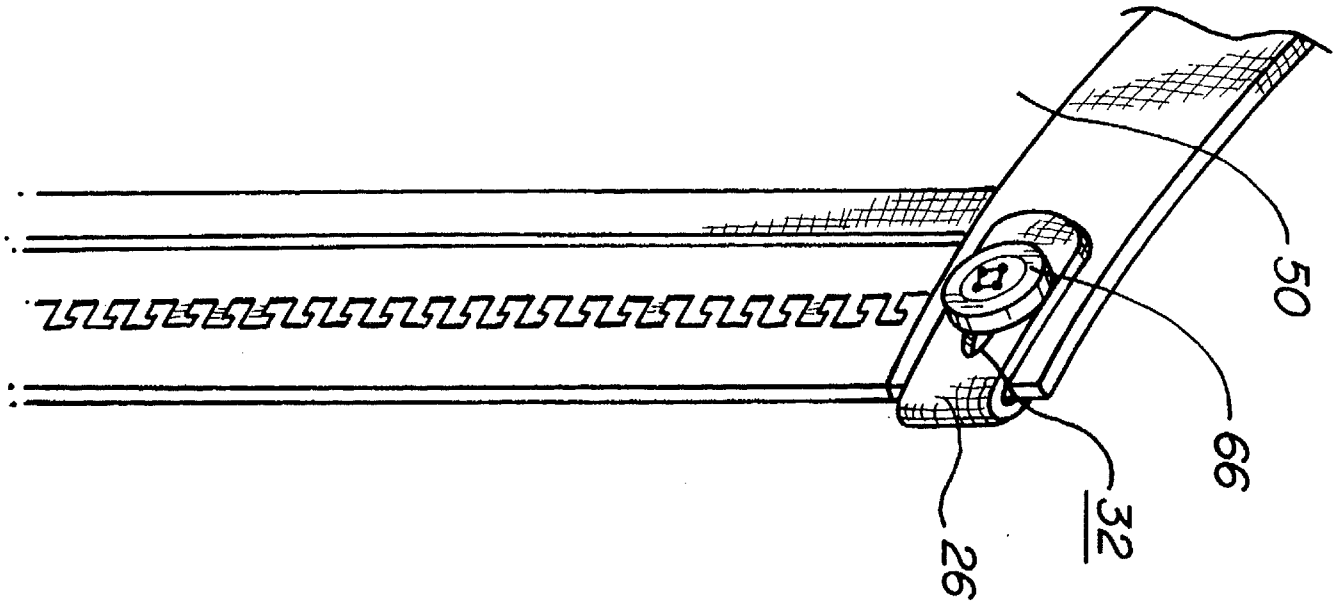
FIG. 6 is a perspective cut-away of attachment of the button connector to the button of the representative garment of FIG. 4.

Attachment and use of concealable wallet 10 is now described with reference to FIGS. 4–6. FIG. 5 shows concealable wallet 10 attached within the interior of slacks 50 adjacent waist band 52. Concealable wallet 10 is attached by fastening adjustable length fastener 28 to a belt loop 56 and placing button hole 32 of button connector 26 over button 66 of slacks 50 (shown in FIG. 6) prior to positioning button hole 70 into place (FIG. 4). Use of concealable wallet is as simple as placing any items desired to be concealed with the sealable compartment within wallet member 12 and sealing sealable opening 18. By attaching one end of attachment strap 14 to button 66, a wearer may readily verify that concealable wallet 10 is secure by glancing down at the button. A observer would simply think the wearer was verifying the position of his zipper.

Figure 7:
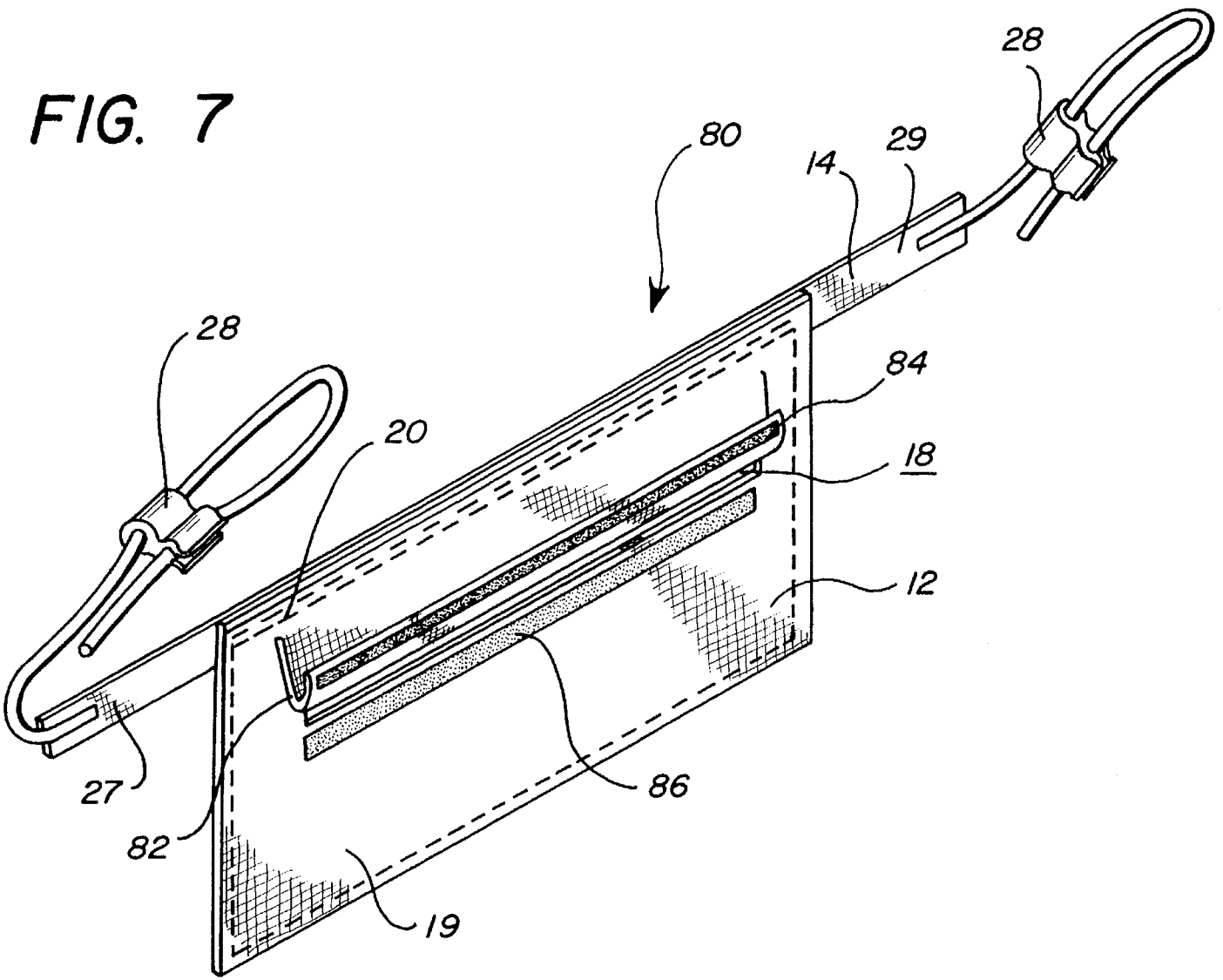
FIG. 7 is a perspective view of a second exemplary embodiment of the concealable wallet of the present invention.

FIG. 7 shows a second exemplary embodiment of the concealable wallet of the present invention generally designated by the numeral 80. Concealable wallet 80 includes a wallet member 12 and an attachment strap 14.

Wallet member 12 is constructed from a substantially rectangularly shaped, 7 inch by 7¼ inch section 16 of denim fabric which has been folded over along the midpoints of the 7 inch sides and double stitched along all four sides to form about a 3 inch by 6¾ inch pocket (not shown). A sealable opening 18 is located on one side 19 of wallet member 12 and adjacent one of the longer sides 20. A flap 82, is attached above sealable opening 18 to allow sealable opening 18 to be sealed when items are stored within the pocket. Strips of hook and pile type fastener 84,86 are attached to flap 82 and a section of side 19 adjacent and below sealable opening 18. Strips 84,86 are detachable securable to each other in a manner to secure flap 82 over sealable opening 18.

Attachment strap 14 is about an 11 inch length of blue, webbed nylon strapping having an adjustable length fastener 28 attached to each end 27,29. Each adjustable length fastener is constructed as previously described herein above.

Figure 8:
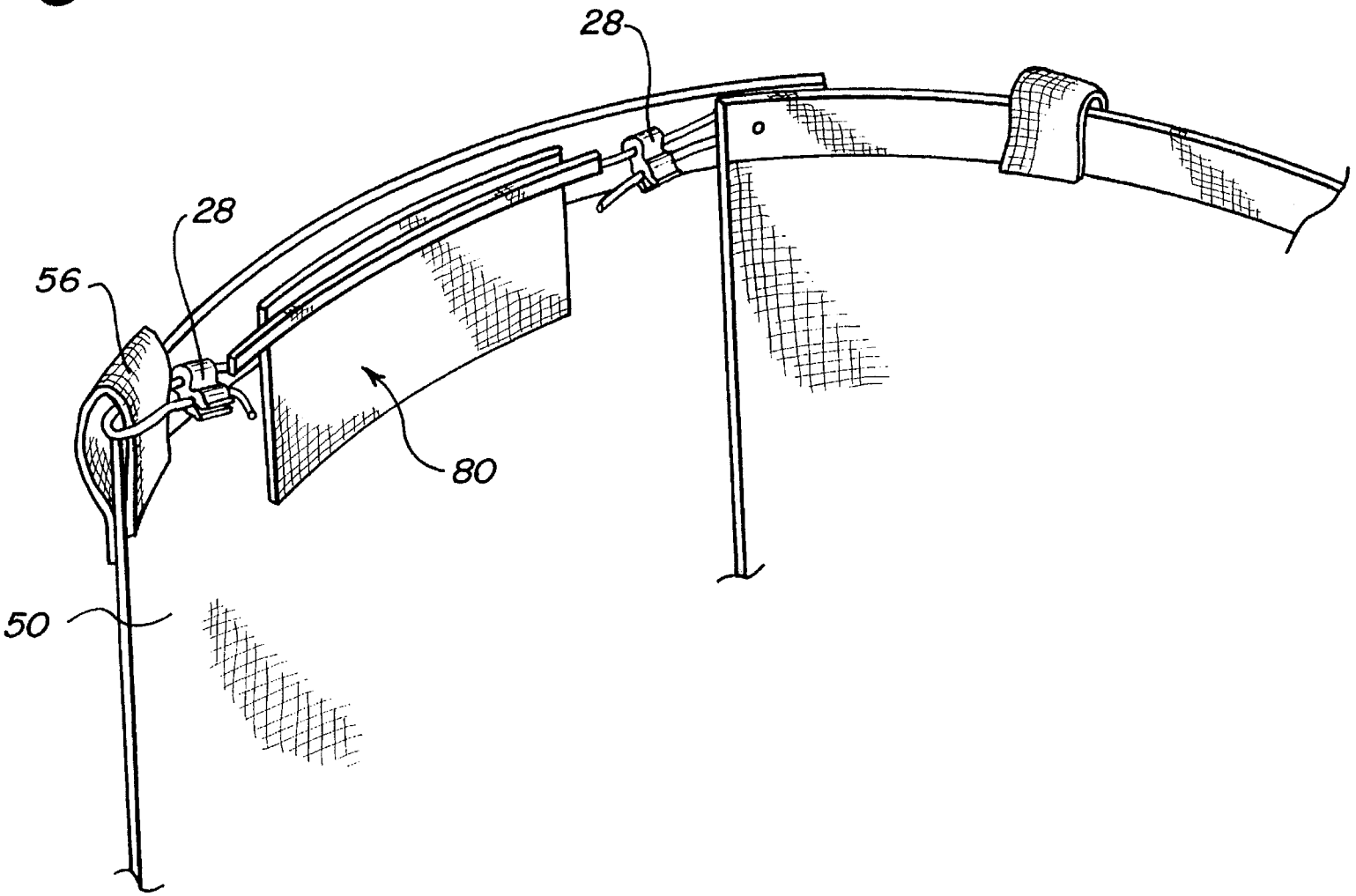
FIG. 8 is a perspective cut-away view of one method of attaching the concealable wallet to the representative garment of FIG. 4.

FIG. 8 illustrates attachment of concealable wallet 80 attached to the representative slacks 50. One adjustable length fastener 28 is secured to a belt loop 56. The other adjustable length fastener 28 is secured about button 66 of slacks 50 prior to positioning button hole 70 into place (FIG. 6). Use of concealable wallet 80 is the same as concealable wallet 10.

It can be seen from the preceding description that a concealable wallet that will allow the user readily to confirm attachment of the wallet while in use, that is comfortable to wear, that may be worn with a variety of differently styled garments has been provided.

It is noted that the embodiment of the concealable wallet described herein in detail for exemplary purposes are of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A concealable wallet for use with a garment comprising:

a wallet member having a first and second sidewall secured together in a manner to form a pocket therebetween, said pocket being accessible through a sealable opening formed through said first sidewall and having a zipper installed in said sealable opening in a manner to allow a user to selectively seal and unseal said sealable opening by operating said zipper; and an elongated attachment strap having a first and second end attached to said second sidewall, said first end extending out past said wallet member and having attached thereto an adjustable length fastening mechanism including a length of flexible cord suitable for fastening about a belt loop of said garment, said second end extending out past said wallet member and having a fastening mechanism including a length of nylon strapping having a button hole formed therethrough to form a button connector suitable for fastening about a button of said garment;

said adjustable length fastening mechanism including a resilient member having a first and second holding channel through which sections of said flexible cord are installed, each of said first and second holding channels are defined by sidewalls which frictionally contact and hold said flexible cord; at least one of said first and second holding channels including an insertion channel running along a side thereof of a size sufficient to allow a section of said flexible cord to be inserted laterally therethrough;

said adjustable length fastening mechanism being adjustable between 1 inch and 6 inches in length, said pocket being of a size sufficient to receive therein a 6¼ inch long, 2⅝ inch wide, ¼ inch thick rectangular object.

* * * * *